US006497079B1

(12) United States Patent
Pletzer et al.

(10) Patent No.: US 6,497,079 B1
(45) Date of Patent: Dec. 24, 2002

(54) MECHANICAL PANEL CONNECTION

(75) Inventors: Stefan Pletzer, Fieberbrunn (AT); Martin Steinwender, Perchtoldsdorf (AT); Jürgen Weber, Ense (DE)

(73) Assignee: E.F.P. Floor Products GmbH, Tirol (AT)

( * ) Notice: Subject to any disclaimer, the term of this patent is extended or adjusted under 35 U.S.C. 154(b) by 0 days.

(21) Appl. No.: 09/712,573

(22) Filed: Nov. 14, 2000

Related U.S. Application Data

(63) Continuation of application No. PCT/EP00/07541, filed on Aug. 3, 2000.

(30) Foreign Application Priority Data

Mar. 7, 2000 (DE) ..... 100 10 351
Mar. 20, 2000 (DE) ..... 100 13 557

(51) Int. Cl.[7] ..... E04F 15/02
(52) U.S. Cl. ..... 52/592.4; 52/592.2
(58) Field of Search ..... 52/592.4, 592.2, 52/590.3, 590.2, 591.3

(56) References Cited

U.S. PATENT DOCUMENTS

| | | | | |
|---|---|---|---|---|
| 752,694 | A | 2/1904 | Lund | |
| 753,791 | A | 3/1904 | Fulghum | |
| 1,124,228 | A | 1/1915 | Houston | |
| 1,776,188 | A | 9/1930 | Langbaum | |
| 1,986,739 | A | 1/1935 | Mitte | |
| 1,988,201 | A | 1/1935 | Hall | |
| 2,276,071 | A | 3/1942 | Scull | |
| 2,282,559 | A | 5/1942 | Byers | |
| 2,430,200 | A | 11/1947 | Wilson | |
| 2,453,918 | A | * 11/1948 | Jansen | 52/590.2 |
| 2,740,167 | A | 4/1956 | Rowley | |
| 2,808,624 | A | 10/1957 | Sullivan | |

(List continued on next page.)

FOREIGN PATENT DOCUMENTS

| | | |
|---|---|---|
| AT | 305 566 | 3/1973 |
| CH | 200 949 | 1/1939 |
| CH | 488 891 | 5/1970 |
| CH | 513 310 | 11/1971 |
| DE | 921 484 | 12/1954 |
| DE | 1 212 275 | 5/1957 |
| DE | 1 212 275 | 3/1966 |
| DE | 1 534 802 | 4/1970 |
| DE | 1 959 794 | 6/1971 |
| DE | 71 02 476 | 6/1971 |

(List continued on next page.)

*Primary Examiner*—Michael Safavi
(74) *Attorney, Agent, or Firm*—Fish & Neave; Garry J. Tuma

(57) ABSTRACT

A panel connection, particularly for flooring panels, having a groove (35) that is formed at a side edge (5); a tongue (32) that is formed at a side edge (6); a depression (39) that is formed in the groove (35) and has an interlocking surface (16); an interlocking groove (34) that is formed at the tongue (32) and has an interlocking surface (26); and fitting surfaces (14, 24), which are formed the groove (35) and at the tongue (32) and serve as abutments for the interlocking surfaces (16, 26). The properties of interlocking and orientation stability are improved in that a recess (40), which is formed by a facing surface (11) that extends perpendicular to the top side (3) and a fitting surface (12) that extends parallel to the top side (3), is provided in the region of the side edge (5). An upper lip (30), which is formed by a facing surface (21) that extends perpendicular to the top side (4) and a fitting surface (22) that extends parallel to the top side (4), is provided in the region of the side edge (6). The fitting surfaces (12, 22) resting against one another and the facing surfaces (11,21) resting against one another in the interlocked state of the connection.

33 Claims, 5 Drawing Sheets

U.S. PATENT DOCUMENTS

Figure 1:
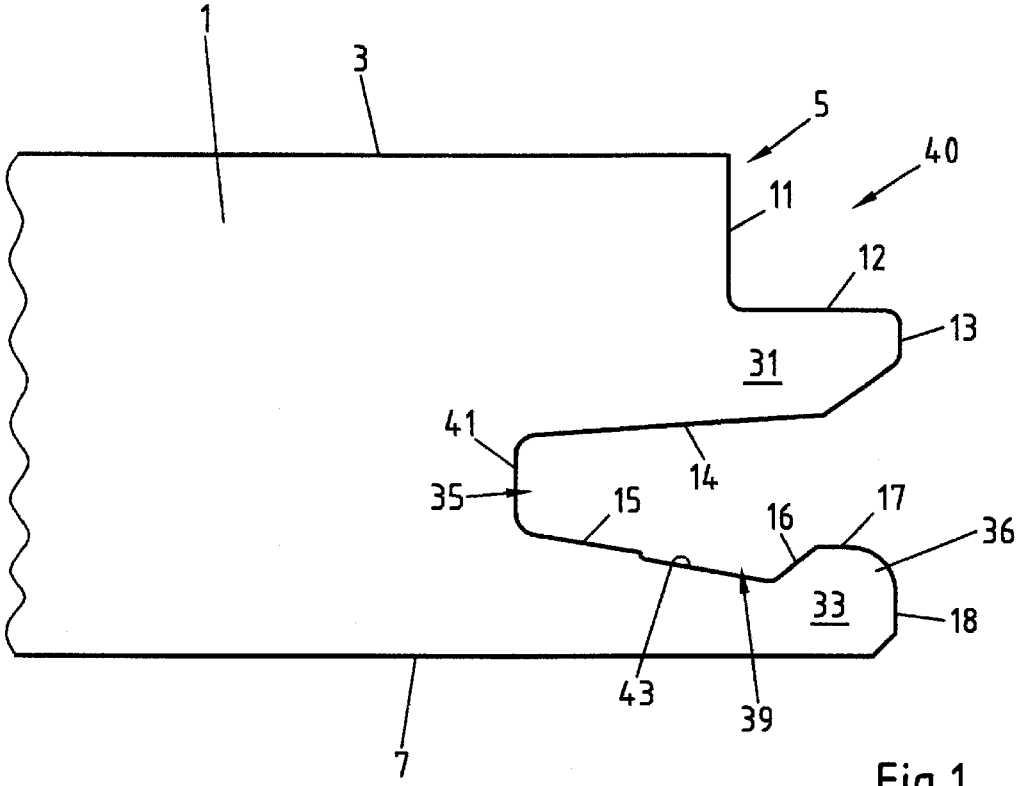

| | | | | |
|---|---|---|---|---|
| 3,045,294 | A | 7/1962 | Livezey | |
| 3,310,919 | A | 3/1967 | Bue et al. | |
| 3,535,844 | A | 10/1970 | Glaros | |
| 3,538,665 | A | 11/1970 | Gohner | |
| 3,694,983 | A | 10/1972 | Conquet | |
| 3,807,113 | A * | 4/1974 | Turner | 52/525 |
| 3,859,000 | A | 1/1975 | Webster | |
| 4,074,496 | A | 2/1978 | Fischer | |
| 4,104,840 | A | 8/1978 | Heintz et al. | 52/309.9 |
| 4,169,688 | A | 10/1979 | Toshio | |
| 4,426,820 | A | 1/1984 | Terbrack et al. | |
| 4,641,469 | A | 2/1987 | Wood | |
| 4,769,963 | A | 9/1988 | Meyerson | |
| 4,819,932 | A | 4/1989 | Trotter, Jr. | |
| 5,029,425 | A | 7/1991 | Bogataj | |
| 5,165,816 | A | 11/1992 | Parasin | |
| 5,216,861 | A | 6/1993 | Meyerson | |
| 5,274,979 | A | 1/1994 | Tsai | |
| 5,294,341 | A | 3/1994 | Kajiwara | |
| 5,349,796 | A | 9/1994 | Meyerson | |
| 5,404,686 | A | 4/1995 | Esposito | |
| 5,502,939 | A | 4/1996 | Zadock et al. | |
| 5,706,621 | A | 1/1998 | Pervan | 52/403.1 |
| 5,860,267 | A | 1/1999 | Pervan | 52/748.1 |
| 6,006,486 | A | 12/1999 | Moriau et al. | 52/589.1 |
| 6,023,907 | A | 2/2000 | Pervan | 52/748.1 |
| 6,094,882 | A | 8/2000 | Pervan | 52/745.19 |
| 6,101,778 | A | 8/2000 | Mårtensson | 52/582.1 |
| 6,182,410 | B1 | 2/2001 | Pervan | 52/403.1 |
| 6,209,278 | B1 | 4/2001 | Tychsen | |
| 6,247,285 | B1 | 6/2001 | Moebus | |
| 6,332,733 | B1 | 12/2001 | Hamberger et al. | |
| 6,345,481 | B1 | 2/2002 | Nelson | |

FOREIGN PATENT DOCUMENTS

| | | | |
|---|---|---|---|
| DE | 2 007 129 | | 9/1971 |
| DE | 1 534 278 | | 11/1971 |
| DE | 2 238 660 | | 2/1974 |
| DE | 74 02 354 | | 5/1974 |
| DE | 25 02 992 | | 7/1976 |
| DE | 26 16 077 | | 10/1977 |
| DE | 29 17 025 | | 11/1980 |
| DE | 67928703.8 | | 7/1981 |
| DE | 30 33 907 | | 5/1982 |
| DE | 81 34 756.1 | | 5/1982 |
| DE | 30 41 781 | | 6/1982 |
| DE | 32 46 376 | | 6/1984 |
| DE | 33 43 601 | | 6/1985 |
| DE | 86 04 004.9 | | 6/1986 |
| DE | 35 44 845 | | 6/1987 |
| DE | 91 02 141.3 | | 5/1992 |
| DE | 92 12 445.3 | | 1/1993 |
| DE | 41 30 115 | | 3/1993 |
| DE | 41 30 115 | A1 | 3/1993 |
| DE | 93 00 306.4 | | 4/1993 |
| DE | 42 15 273 | | 11/1993 |
| DE | 42 42 530 | | 6/1994 |
| DE | 44 00 572 | | 8/1994 |
| DE | 94 14 636.5 | | 3/1995 |
| DE | 93 17 191.9 | | 4/1995 |
| DE | 44 02 352 | | 8/1995 |
| DE | 295 11 769 | | 11/1995 |
| DE | 295 13 007 | | 11/1995 |
| DE | 295 17 128 | | 2/1996 |
| DE | 195 14 165 | | 3/1996 |
| DE | 195 03 948 | | 8/1996 |
| DE | 296 09 590 | | 8/1996 |
| DE | 296 08 195 | | 9/1996 |
| DE | 195 11 766 | | 10/1996 |
| DE | 195 12 423 | | 10/1996 |
| DE | 295 20 966 | | 10/1996 |
| DE | 296 10 462 | | 10/1996 |
| DE | 296 19 983 | | 2/1997 |
| DE | 297 03 962 | | 6/1997 |
| DE | 297 10 175 | | 9/1997 |
| DE | 297 16 028 | | 12/1997 |
| DE | 297 19 986 | | 3/1998 |
| DE | 298 03 708 | | 7/1998 |
| DE | 197 09 641 | | 9/1998 |
| DE | 694 13 391 | | 9/1998 |
| DE | 197 18 319 | | 11/1998 |
| DE | 298 15 780 | | 6/1999 |
| DE | 299 11 462 | | 12/1999 |
| DE | 694 21 945 | | 12/1999 |
| DE | 694 22 838 | | 1/2000 |
| DE | 298 23 749 | | 2/2000 |
| DE | 198 51 200 | | 3/2000 |
| DE | 298 22 341 | | 4/2000 |
| DE | 299 22 649 | | 4/2000 |
| DE | 200 02 413 | | 5/2000 |
| DE | 299 21 814 | | 5/2000 |
| DE | 198 51 656 | | 6/2000 |
| DE | 200 00 484 | | 6/2000 |
| DE | 200 04 359 | | 6/2000 |
| DE | 198 59 038 | | 7/2000 |
| DE | 199 01 595 | | 8/2000 |
| DE | 200 01 225 | | 8/2000 |
| DE | 200 01 788 | | 8/2000 |
| DE | 296 23 914 | | 8/2000 |
| DE | 200 05 877 | | 11/2000 |
| DE | 200 12 913 | | 11/2000 |
| DE | 200 13 380 | | 12/2000 |
| DE | 297 24 334 | | 1/2001 |
| EP | 0 196 672 | | 10/1986 |
| EP | 0 248 127 | A1 | 12/1987 |
| EP | 0 637 659 | A1 | 2/1995 |
| EP | 0 652 340 | | 5/1995 |
| EP | 0 665 347 | | 8/1995 |
| EP | 0 690 185 | | 1/1996 |
| EP | 0 715 037 | A1 | 6/1996 |
| EP | 0 733 756 | A2 | 9/1996 |
| EP | 0 790 369 | | 8/1997 |
| EP | 0 906 994 | A1 | 4/1999 |
| EP | 0 877 130 | B1 | 1/2000 |
| EP | 0 969 163 | A2 | 1/2000 |
| EP | 0 969 164 | A2 | 1/2000 |
| EP | 0 976 889 | | 2/2000 |
| EP | 1 024 234 | A2 | 8/2000 |
| EP | 1 026 340 | | 8/2000 |
| EP | 1 026 341 | A2 | 8/2000 |
| EP | 0 843 763 | B1 | 10/2000 |
| FR | 1 175 582 | | 3/1959 |
| FR | 1 293 043 | | 4/1962 |
| FR | 2 102 505 | | 4/1972 |
| FR | 2 487 407 | | 1/1982 |
| FR | 2 568 295 | | 1/1986 |
| FR | 2 630 149 | | 10/1989 |
| FR | 2 691 491 | | 11/1993 |
| FR | 2 697 275 | | 4/1994 |
| GB | 424057 | | 2/1935 |
| GB | 463190 | | 3/1937 |
| GB | 614394 | | 12/1948 |
| GB | 1 381 986 | | 1/1975 |
| GB | 1 430 423 | | 3/1976 |
| GB | 2 117 813 | A | 10/1983 |
| GB | 2 243 381 | A | 10/1991 |
| GB | 2 256 023 | A | 11/1992 |
| JP | 54-65528 | | 5/1979 |
| JP | 56-88825 | | 7/1981 |
| JP | 57-119056 | | 7/1982 |

| | | | |
|---|---|---|---|
| JP | 64-14838 | | 1/1989 |
| JP | 1-35858 | | 11/1989 |
| JP | 2-9243 | | 1/1990 |
| JP | 3-46645 | | 4/1991 |
| JP | 3-107056 | | 5/1991 |
| JP | 3-169967 | | 7/1991 |
| JP | 4-297654 | | 10/1992 |
| JP | 5-25916 | | 2/1993 |
| JP | 6-146553 | | 5/1994 |
| JP | 6-200611 | | 7/1994 |
| JP | 6-56310 | | 8/1994 |
| JP | 6-320510 | | 11/1994 |
| JP | 7-13967 | | 3/1995 |
| JP | 7-180333 | | 7/1995 |
| JP | 7-292944 | | 11/1995 |
| JP | 8-109734 | | 4/1996 |
| JP | 9-13631 | | 1/1997 |
| JP | 9-256604 | | 9/1997 |
| WO | 84/02155 | A1 | 6/1984 |
| WO | 87/07667 | A1 | 12/1987 |
| WO | 93/13280 | A1 | 7/1993 |
| WO | 94/01628 | A2 | 1/1994 |
| WO | 94/04773 | A1 | 3/1994 |
| WO | 94/26999 | A1 | 11/1994 |
| WO | 95/06176 | A1 | 3/1995 |
| WO | 96/06248 | A1 | 2/1996 |
| WO | 96/18782 | A1 | 6/1996 |
| WO | 96/23942 | A1 | 8/1996 |
| WO | 96/27719 | A1 | 9/1996 |
| WO | 96/27721 | A1 | 9/1996 |
| WO | 98/21428 | A1 | 5/1998 |
| WO | 98/22677 | A1 | 5/1998 |
| WO | 98/24995 | A1 | 6/1998 |
| WO | 98/40583 | A1 | 9/1998 |
| WO | WO 98/58142 | | 12/1998 |
| WO | 99/14452 | A1 | 3/1999 |
| WO | 99/40273 | A1 | 8/1999 |
| WO | 99/66151 | A1 | 12/1999 |
| WO | 99/66152 | A1 | 12/1999 |

* cited by examiner

MECHANICAL PANEL CONNECTION

This application claims the benefit of International Patent Application PCT/EP00/07541, filed Aug. 3, 2000, German Patent Application No. 100 10 351.0, filed Mar. 7, 2000, and German Patent Application No. 100 13 557.3, filed Mar. 20, 2000.

The invention relates to a mechanical connection of sheet-type panels, as are typically used for a floor covering, such as parquet or laminate flooring, or for ceiling and wall tiling.

In all cases, the individual panels can be joined through a mechanical connection, i.e., interlocking, to form a flat surface, so the panels can be laid without adhesives or additional mechanical fastening elements, such as screws or nails. A particular advantage of this is that the panels can be laid without adhesive bonding, and can therefore be removed.

JP 3-169967 A, on which the present invention is based, describes a mechanical connection of flooring panels. Along a first side edge, the panels are provided with a groove, which is formed by an upper lip and a lower lip and extends parallel to the side edge. Embodied on an opposite side edge of the further, second panel is a tongue, which extends parallel to this side edge. A depression having an interlocking surface that extends at an incline with respect to the top side of the panel is embodied in the groove. A corresponding interlocking element, which has an interlocking surface that extends at an incline with respect to the top side, is embodied at the tongue. Furthermore, fitting surfaces that extend parallel to the top side and serve as abutments for the interlocking surfaces of the groove depression and the interlocking element of the tongue are embodied in the groove and at the tongue, at the end facing the respective side edge. In the direction parallel to the top side, the upper lip covers the interlocking surface embodied opposite it in the groove. In the interlocked state of the connection, the fitting surfaces and the interlocking surfaces fit closely together in pairs in order to keep the side edges in contact. Through the cooperation of the fitting surfaces and the interlocking surfaces, the impacting side edges of two panels rest tightly against one another, forming a virtually gap-free connection.

Further mechanical panel connections are known from the prior art disclosed in WO 94/26999, WO 96/27721, WO 97/47834 and WO 98/58142.

A common feature of the mechanical panel connections known from the prior art is that they permit a reliable mechanical interlocking in the direction parallel to the top side of the panels, yet they possess a low rigidity with respect to a rotation of the panel at the adjacent side edges. Hence, the panels can be pivoted relative to one another fairly easily, leading to a loosening of the mechanical connection. In the prior art, this is even desirable to a certain extent for simple panel laying. On the other hand, these known panels possess a sufficient rigidity in terms of the aforementioned tilting and pivoting of the panels relative to one another, but the panel interlocking of the connection is inadequately rigid. In addition, the fitting in the direction perpendicular to the top side is limited to only one fitting-surface pair, so the adjacent side edges do not match exactly in height, thus forming a noticeable step.

The technical problem facing the invention, therefore, is to provide a mechanical connection of panels that is distinguished by improved interlocking and stability properties.

In accordance with the invention, the outlined technical problem is solved by a connection possessing the features of the preamble to claim 1, namely that a recess formed by a surface extending essentially perpendicular to the top side and a fitting surface extending parallel to the top side is provided in the region of the side edge, and an upper lip formed by the top side, a surface extending essentially perpendicular to the top side and a fitting surface extending parallel to the top side is provided in the region of the side edge, with the fitting surfaces and the other surfaces resting against one another in the interlocked state of the connection.

In accordance with the invention, the two panels are stabilized against tilting or pivoting along the side edges in the interlocked state by the additional fitting surfaces in the region of the recess. The interlocking, in contrast, is effected by the pair of interlocking surfaces and the pair of fitting surfaces disposed at the end facing the side edges, and acting as abutments. Therefore, the force generated by the interlocking surfaces effectively prevents the two panels from moving apart in a plane parallel to the top sides and perpendicular to the side edges. Thus, different fitting-surface pairs assure the interlocking, on the one hand, and the stabilization of the orientation of the two panels, on the other hand.

A further advantage of the mechanical panel connection according to the invention is that the fitting surface in the region of the recess of the first panel and at the upper lip of the second panel permits a very precise adaptation of the top sides of the two panels relative to one another, which effectively prevents the occurrence of uneven areas at the adjacent side edges.

In a preferred manner, the fitting surface that is disposed opposite the interlocking surface inside the groove of the first side edge extends at an incline with respect to the top sides. Consequently, the tongue to be inserted is guided during the joining process of the two panels.

If, in contrast, these fitting surfaces extend parallel to the top sides, an additional fitting is advantageously effected in the vertical direction, in addition to the fitting-surface pair of the invention.

It is further preferable for the end surface of the upper lip and the end surface of the interlocking lip of the first side edge to be arranged in essentially one plane. In this case, joining the panels by means of force prevents the impact force from being absorbed by only one of the two lips, resulting in a more uniform joining of the two panels.

Figure 2:
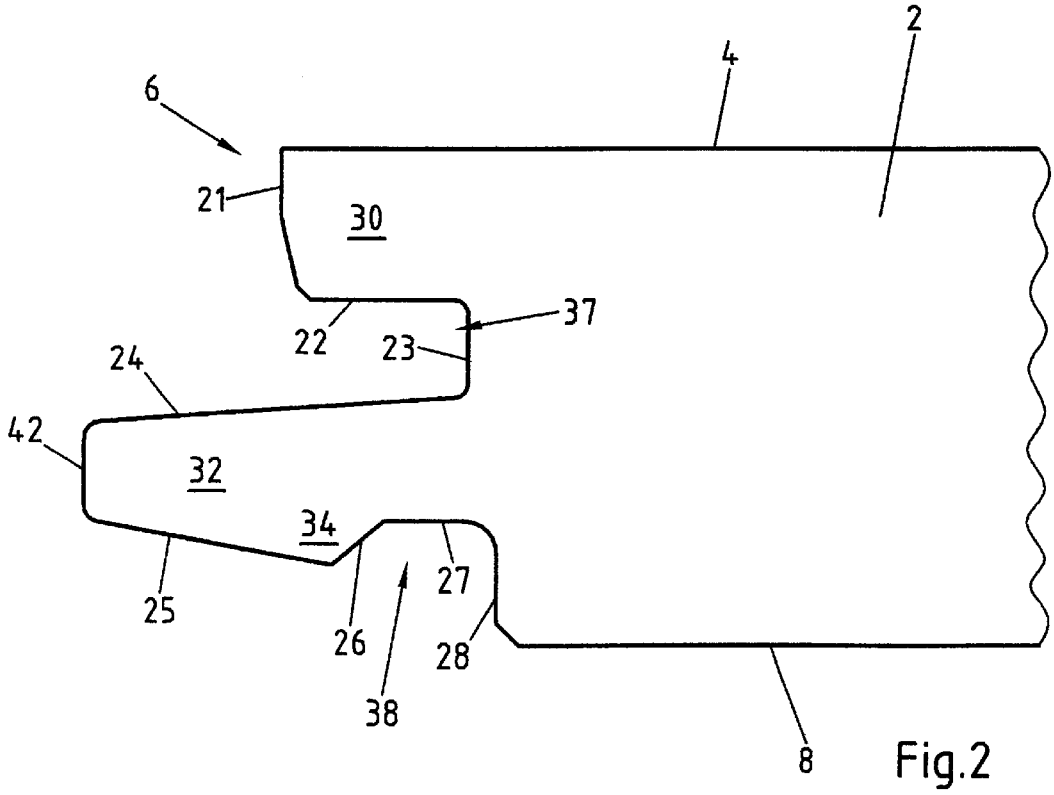
Figure 3:
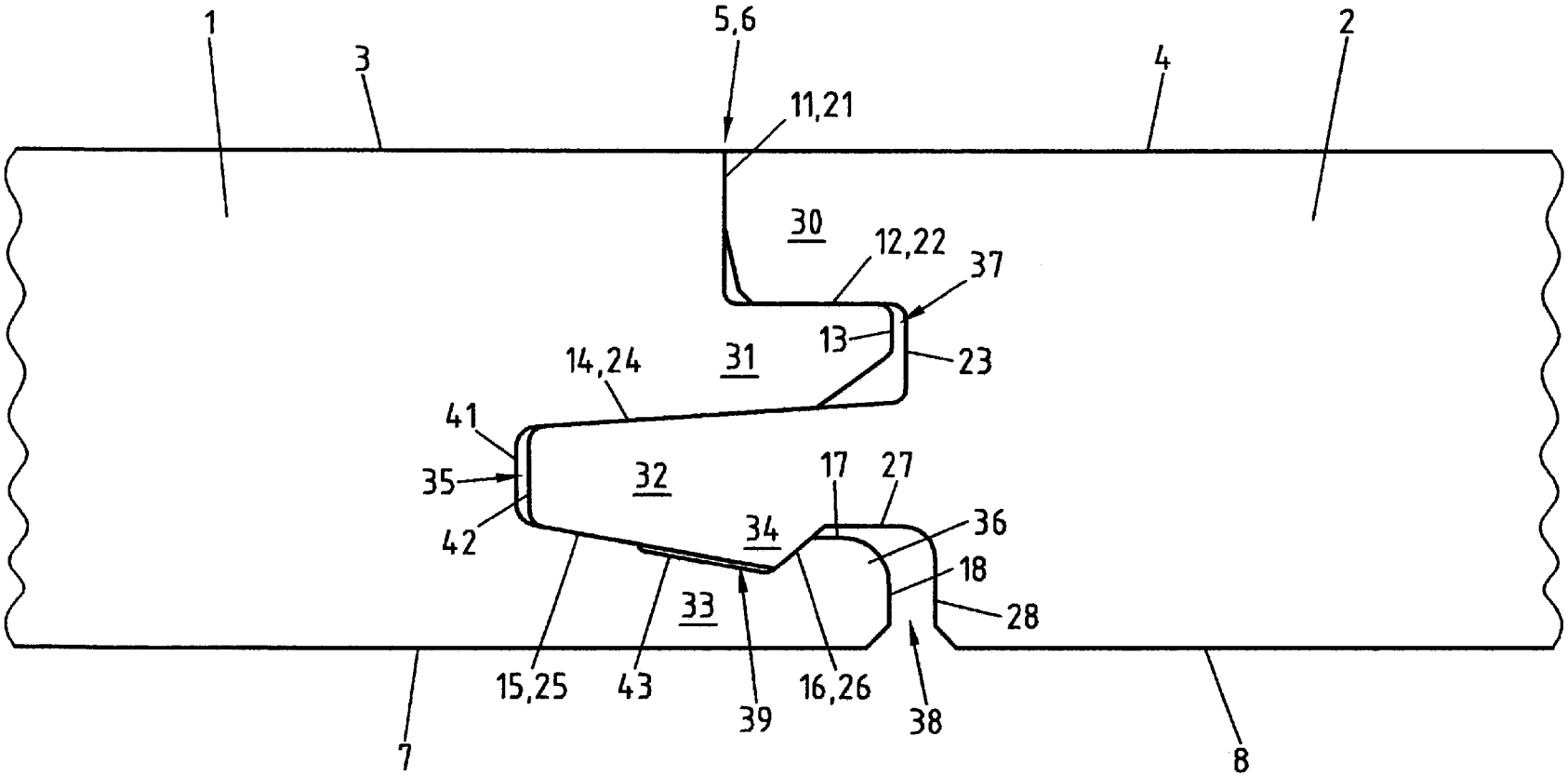
Figure 4:
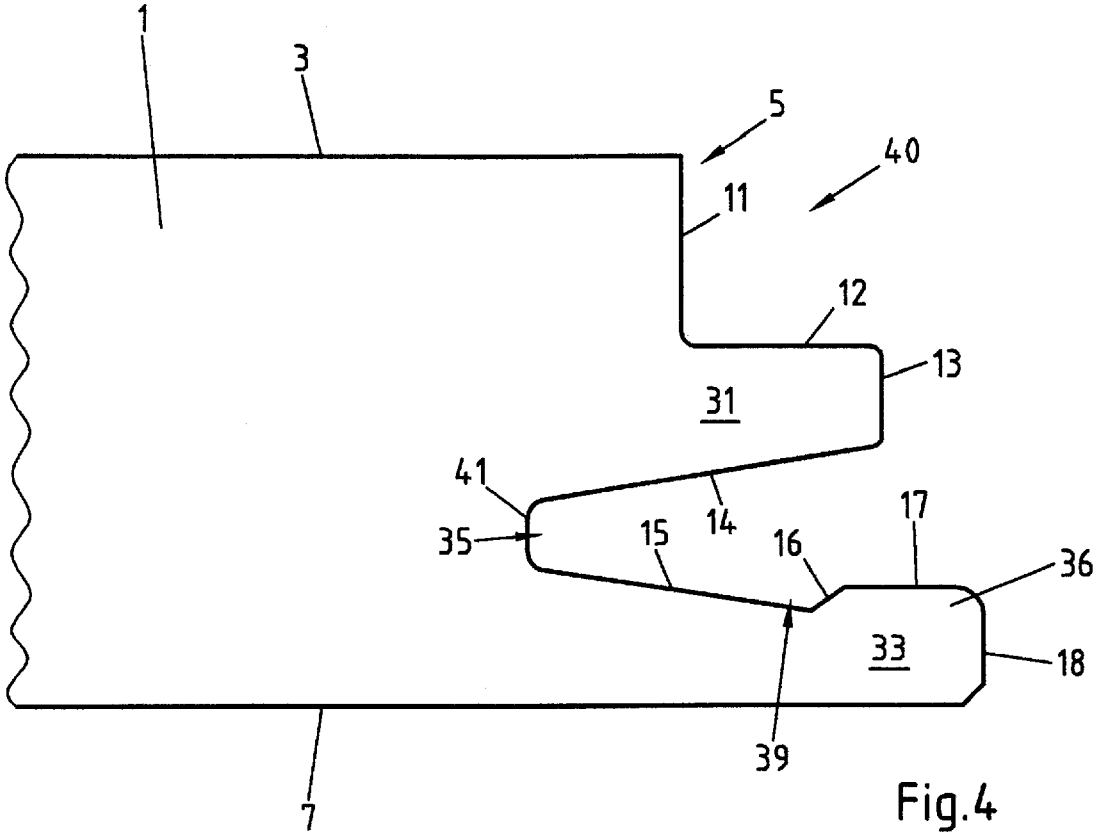
Figure 5:
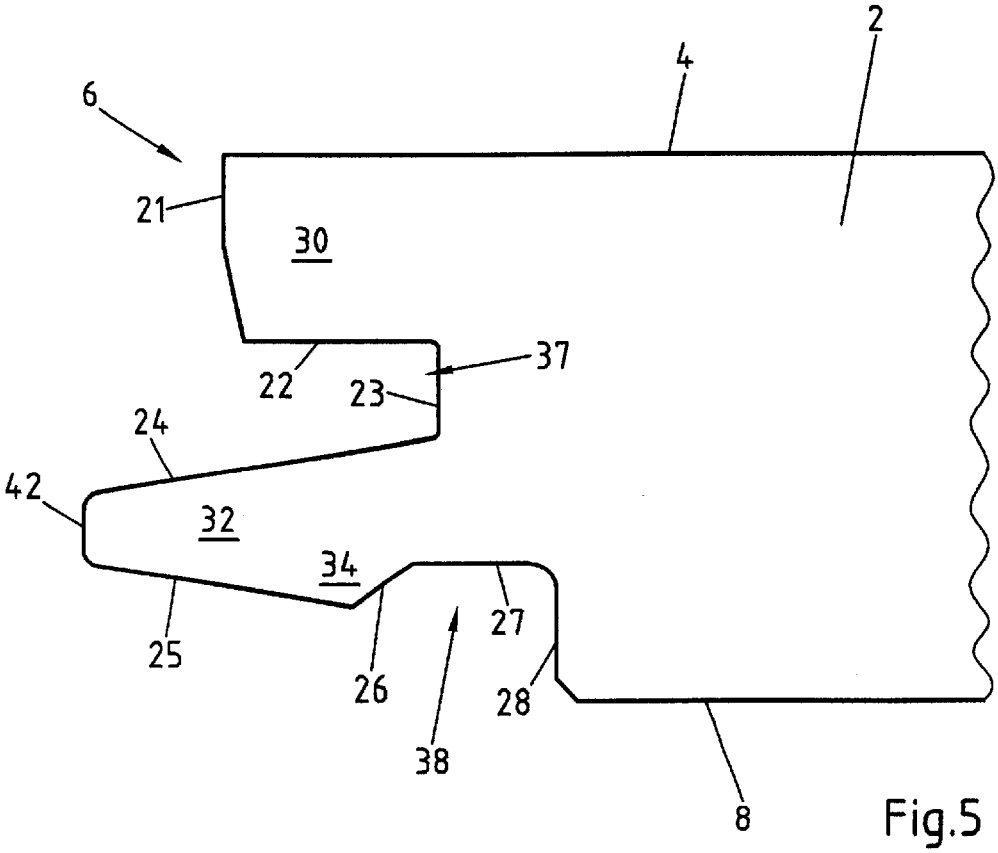
Figure 6:
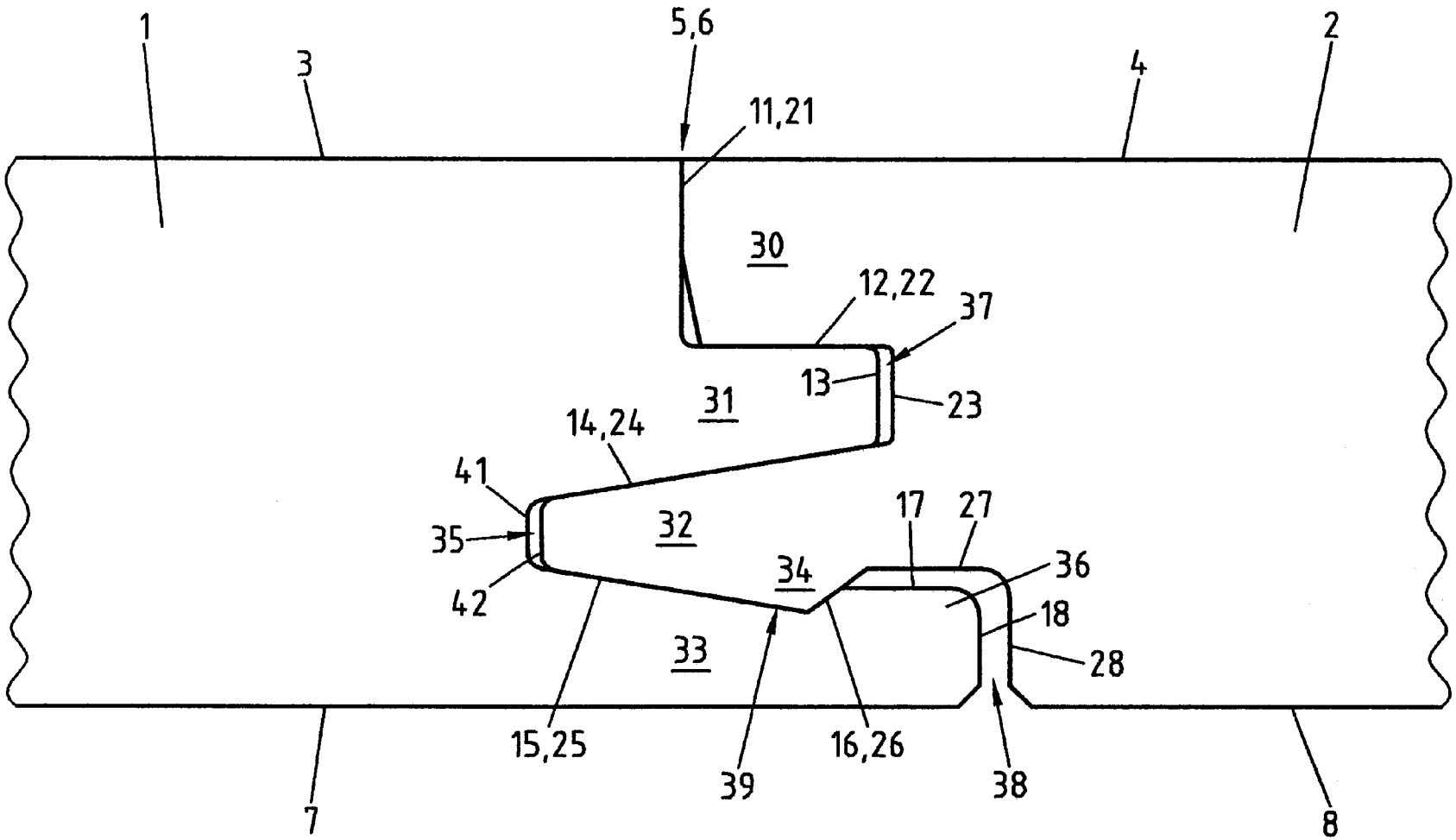
Figure 7:
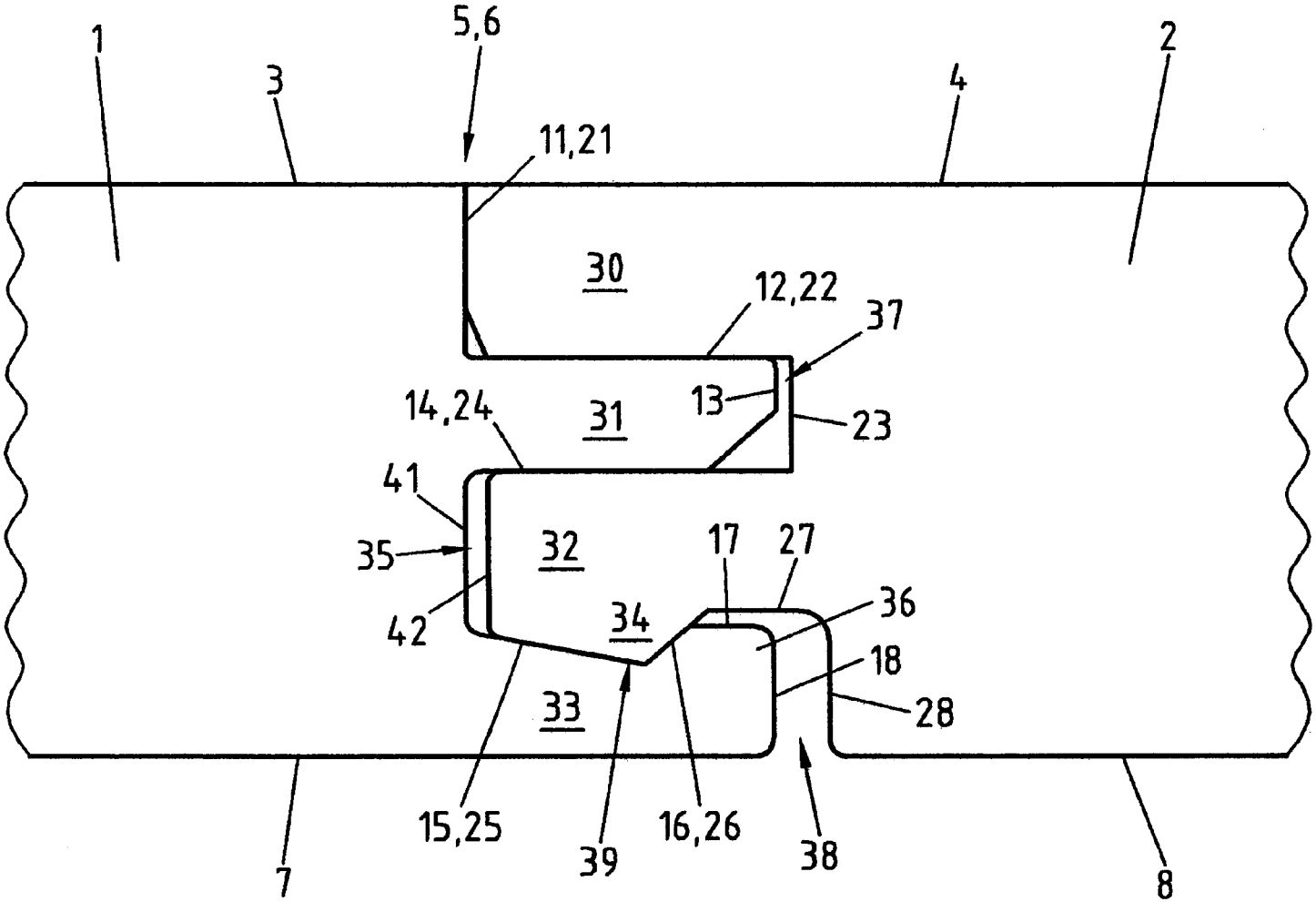

The invention is described below by way of two exemplary embodiments of flooring panels, with reference to the drawing, which shows in:

FIG. 1 a profile of a first side edge of a first connection according to the invention, in a cross section;

FIG. 2 a profile of a second side edge of the first connection according to the invention, in a cross section;

FIG. 3 the profiles illustrated in FIGS. 1 and 2, in the engaged state;

FIG. 4 a profile of a first side edge of a second connection according to the invention, in a cross section;

FIG. 5 a profile of a second side edge of the second connection according to the invention, in a cross section;

FIG. 6 the profiles illustrated in FIGS. 4 and 5, in the engaged state; and FIG. 7 a connection of two panels of a third exemplary embodiment.

All of the panel surfaces described below extend entirely, or at least in sections, along a longitudinal or transverse edge of the panels 1 and 2, which will be generally referred to hereinafter as a side edge.

FIGS. 1 through 7 depict three exemplary embodiments in detail. The profiles of these embodiments are similar, and are therefore represented by the same reference characters. The profiles basically differ only by the lengths of the lower lips and tongues in the horizontal direction, which are discussed at the end of the description.

FIGS. 1 and 4 illustrate a first panel 1, which has a top side 3 and an underside 7. The profile along the side edge 5 of the panel 1 is enclosed by a plurality of surfaces 11 through 18, which extend as follows.

The surface 11 limits the top side 3 at the side edge 5, and extends downward essentially vertically. Adjoining this surface is a surface 12, which extends essentially horizontally, and thus parallel to the top side 3, and is in turn limited by the vertical surface 13. A rounded region, which forms a hollow space when the panels 1 and 2 are joined, is embodied between the surfaces 11 and 12 in a preferred manner. In addition, the surfaces 11 and 12 limit a stepped recess 40, the function of which will be described in detail below.

Adjoining the surface 13 is the surface 14, which extends diagonally downward in the direction of the body of the panel 1. The surfaces 12, 13, and 14 enclose an upper lip 31. Adjoining the lower surface 14 of the upper lip 31 is a surface 15, which is oriented diagonally downward and away from the body of the panel 1. In the first embodiment shown in FIGS. 1 and 3, in the region of an edge, the surface 15 changes over to a surface 43, which extends at the same angle as the surface 15 with respect to the top side 3. The surface 43 is thus offset downward, essentially parallel to the surface 15.

The two surfaces 14 and 15, as well as 43, surround a groove 35, into which the tongue 32 described below can extend. The groove bottom 41 embodied between the surfaces 14 and 15 has a curved extension, so a hollow space forms in the latched state—see FIGS. 3 and 6. Like the hollow space embodied at the transition between the surfaces 11 and 12, this hollow space can serve to collect dust or adhesive, if applicable, without the relative positions of the other contact surfaces being impacted. It is emphasized here that adhesive is only used as an additional measure that is not necessary for the mechanical interlocking.

As described above, the element 31 represents the upper lip of the groove 35, on the one hand, and on the other hand, a tongue, which can extend into a groove 37 described below. Thus, the two terms "upper lip" and "tongue" are used interchangeably for the same element 31.

The surface 15 and the surface 43 change over into the surface 16, which is likewise oriented outward, but extends upward. Adjoining this surface are the surfaces 17 and 18, with the surface 17 extending essentially parallel to the underside 7, that is, horizontally, and the surface 18 extending essentially vertically and limiting the underside 7.

The surfaces 15 and possibly 43, 16, 17, 18 and 7 form the interlocking lip 33, with the surfaces 16, 17 and 18 forming an upward-protruding interlocking element 36 and the surfaces 15 and 16 forming an interlocking groove 39.

The profile of the side edge 6 of the panel 2 is adapted to the above-described profile of the side edge 5 of the panel 1. For this purpose, surfaces 21 through 28 are provided, constituting the following arrangement.

Surface 21 limits the top side 4 of panel 2 at the side edge 6, and extends essentially vertically downward. A surface 22 adjoins the surface 21, and extends essentially parallel to the top side 4, that is, horizontally. With the top side 4 and the surface 21, surface 22 forms an upper lip 30 of the profile of the panel 2. Adjoining this lip are surfaces 23 and 24, which form a groove 37 with the surface 22. Surface 23 connects the surface 22 to the surface 24, and extends essentially vertically downward. The surface 24 extends with a diagonal, downward and outward orientation, so that groove 37 widens toward the outside edge.

The surface 24 changes over to the essentially vertical surface 42, and then to the surface 25 oriented diagonally downward and away from the side edge 6, thereby forming a lower lip or tongue 32, whose end surface is the surface 42. The element 32 represents the lower lip of the groove 37, on the one hand, and the tongue extending into the groove 35 of the other profile, on the other hand. The terms "upper lip" and "tongue" are therefore used interchangeably for the element 32.

Adjoining the surface 25 at the underside of the tongue 32 is a surface 26, which is oriented inward and extends diagonally upward, with the angle of inclination of the surface 26 being larger than the angle of inclination of the surface 25, relative to the outsides 4 and 8. The surfaces 25 and 26 enclose an interlocking element 34, which is preferably provided with a rounded region at its lower end. This simplifies the sliding of the interlocking element on the surface 17 while the two panels 1 and 2 are being pushed together, because no high frictional forces are generated, as in a pointed embodiment.

The adjoining surfaces 27 and 28 extend essentially parallel to the underside 8, on the one hand, while the surface 28 extends essentially parallel thereto. The surfaces 26, 27 and 28 form an interlocking groove 38.

FIGS. 3, 6 and 7 show the mechanical engagement of the two panels 1 and 2. The side edges 5 and 6 of the top sides 3 and 4 border the surfaces 11 and 21, and form a virtually closed top side, basically without a laying groove or laying gap.

It is emphasized here that, in the interlocked state, only the two surfaces 11 and 21 extending perpendicular to the top sides 3 and 4 rest against one another, thereby defining the relative position of the two panels. In contrast, all of the further profile surface pairs that extend essentially vertically are spaced from one another.

The groove 37 enclosed by the upper lip 30 and the lower lip 32 in the panel 2 receives the tongue 31 of the profile of the panel 1, with the essentially horizontal surfaces 12 and 22 and the inclined surfaces 14 and 24 resting against one another. The recess 40 receives the upper lip 30. The groove 35 formed by the upper lip 31 and the interlocking lip 33 receives the tongue 32 in the same manner. Moreover, the interlocking element 34 is disposed in the interlocking groove 39. The interlocking element 36 further extends into the interlocking groove 38. This interlocking mechanism prevents the two panels 1 and 2 from sliding apart horizontally, on the one hand, and permits a precise adjustment of the two panels 1 and 2 in terms of their perpendicular position relative to one another.

Another way to describe the interlocking mechanism is to state that the surface pair 11, 21 and the interlocking-surface pair 16, 26 effect the interlocking in the horizontal direction in the figures. In contrast, the vertical interlocking or fitting is realized by the surface pairs 12, 22; 14, 24 and 15, 25.

As ensues from the above description, the two profiles of the panels 1 and 2 are no longer clearly distinguished from one another in that the one profile constitutes the groove side and the other profile constitutes the tongue side. Rather, the structural embodiments of both a groove and a tongue are provided on the two corresponding profiles of the side edges 5 and 6. For the profile of the panel 1, these are the upper lip or tongue 31, the groove 35 and the interlocking lip 33. For the profile of the panel 2, they are the upper lip 30, the groove 37, the lower lip or tongue 32 and the interlocking groove 38, into which the interlocking element 36 extends at the distal end of the interlocking lip 33.

In the cooperation of the two profiles, the two functions of the mechanical interlocking in the horizontal direction, on the one hand, and the vertical positioning by fitting surfaces, on the other hand, are separated by separate structural elements. This separation effects a better stability of the panels 1 and 2 laid on a floor.

An advantageous embodiment of the tongue 32 lies in the fact that the front end surface, namely the distal end, of the tongue 32 projects beyond the vertical extension of the surface 21—on the left in FIGS. 2 and 5. Consequently, in the type of laying described below, the impact block does not come to rest against the surface 21, and thus the side edge 6, possibly damaging it, but the impact only affects the distal end of the tongue 32.

The above-described profiles are laid in the following manner. The panel 2 is located in its provided position, and the panel 1 is displaced toward the panel 2 in the direction perpendicular to the side edges 5 and 6 until a specific resistance is perceptible. Afterward, an impact block placed on the edge of the panel 1 opposite the side edge 5 effects the engagement of the two profiles through an impact force.

Additionally, the laying process can be reversed in that the panel 1 is located in its predetermined position, and the panel 2 is moved relative thereto until a specific resistance is perceptible. The impact block is then placed against the side edge opposite the side edge 6.

As the two side edges 5 and 6 move toward one another, the interlocking lip 33 is bent downward by the contact of the interlocking element 34, which is formed by the surfaces 25 and 26, with the surface 17. Furthermore, the two surfaces 14 and 24 come to rest against one another, and force the two panels 1 and 2 into the relative position they assume in the interlocked state. In this position, the surfaces 11, 21; 12, 22; 14, 24; 15, 25; and 16, 26 rest at least partially against one another, which attains a defined interlocked state in the horizontal direction, that is, the direction of the top sides 3 and 4, and the direction perpendicular thereto.

Whereas, in the second and third exemplary embodiments, the surfaces 15 and 25 rest against each other from end to end, in the first embodiment according to FIG. 3, the surface 15 only covers the section of the surface 25 facing the front end of the tongue 32 because of the downward offsetting of the surface 43. In contrast, a gap is embodied between the surfaces 43 and 25. This gap effects a better precision of the contact between the interlocking surfaces 16 and 26.

According to the third exemplary embodiment of the profiles shown in FIG. 7, the surfaces 14 and 24 are not inclined, as illustrated in FIGS. 1 through 6, but the surfaces 14 and 24 are oriented essentially parallel to the top sides 3 and 4. The panels 1 and 2 are then guided into their end positions, as described above. In contrast, however, the horizontal orientation improves the fitting in the vertical direction.

Both panel 1 and panel 2 can be provided all the way around with either the profile illustrated in FIGS. 1 and 4, or the profile illustrated in FIGS. 2 and 5, so a plurality of panels 1 and 2 can be joined to form a sheet-type arrangement. To this end, the panels are provided with a profile according to FIGS. 1 and 4 on a respective longitudinal side and transverse side, and on the other sides according to FIGS. 2 and 5.

The exemplary embodiments shown in FIGS. 1 through 7 exhibit one-piece embodiments of the components in or on the panel 1, on the one hand, and in or on the panel 2, on the other hand. Of course, it is also possible to embody the components in multiple pieces, thereby using, for example, plastic or metal profiles that can be used in combination with the wooden panel materials. The invention is therefore not limited to a one-piece embodiment.

As ensues from a comparison of the embodiments of FIGS. 1 through 3, FIGS. 4 through 6 and FIG. 7, the profiles are primarily distinguished by the dimensions of the lower lip 33 in the horizontal direction, that is, parallel to the surfaces 3 and 4 or 7 and 8, respectively, and the dimensions of the tongue 32.

In the second embodiment according to FIGS. 4 through 6, the lower lip 33 projects beyond the distal end of the tongue 31, while in the first embodiment according to FIGS. 1 through 3, the lower lip 33 essentially extends as far as the upper lip 31. In contrast, the lengths of the tongues and grooves in the third embodiment are basically the same.

Thus, in all of the exemplary embodiments, the groove 39 formed by the surfaces 15 and 16 is disposed completely on the closer side of the distal end of the tongue 31, in other words, the surface 13, when seen from the panel, which is on the left in FIGS. 1, 4 and 7. The groove formed by the surfaces 15 and 16, however, is at least partially disposed on the other side of the surface 11, which is on the right in FIGS. 1, 4 and 7. Accordingly, the interlocking element 34 is disposed on the further side of the surface 23 when seen from the panel, which is on the left in FIGS. 2, 5 and 7, and on the closer side of the surface 21, which is on the right in FIGS. 2 and 5. Moreover, the floor of the groove 35 formed by the surfaces 14 and 15 is cut deeper into the material of the panel 1 than the surface 11, while the distal end of the tongue 32 projects beyond the surface 21.

The cooperation of the surfaces in the latched state effects a good vertical stability, on the one hand. On the other hand, the surfaces 16 and 26 resting against one another under a prestress due to the interlocking lip 33 exert a torque that acts on the adjacent edges 5 and 6. This torque is not transmitted entirely onto the edges 5 and 6 because of the interposed tongues 31 and 32; nevertheless, it permits the side edges 5 and 6 to rest sufficiently against one another.

What is claimed is:

1. A panel connection, particularly for flooring panels, comprising:

a first panel (1) having a first side edge (5), the first side edge having a first upper lip (31) and a lower lip (33) forming a groove (35) that extends parallel to the first side edge (5), the groove (35) having a first surface (16) on the lower lip (33) extending at an upward incline with respect to a first top side (3) of the first panel (1), the groove (35) also having a second surface (14) on the upper lip (31) opposite the first surface (16), the first upper lip (31) completely covering the first surface (16), the first side edge (5) also having a recess (40) formed by a third surface (11) and a fourth surface (12), the third surface (11) extending substantially perpendicular to the first top side (3) and the fourth surface (12) extending substantially parallel to the first top side (3); and a second panel (2) having a second side edge (6), the second side edge (6) having a tongue (32) extending parallel to the second side edge (6), the tongue (32) having a fifth surface (26) on the bottom thereof extending at an upward incline with respect to a second top side (4) of the second panel (2), the tongue (32) also having a sixth surface (24) forming the top thereof, the second side edge (6) also having a second upper lip (30) formed by a seventh surface (21) and an eighth surface (22), the seventh surface (21) extending substantially perpendicular to the second top side (4) and the eighth surface (22) extending substantially parallel to the second top side (4), the tongue (32) and the second upper lip (30) forming a second groove (37); wherein, in an interlocked state of the connection:

the second and sixth surfaces (14, 24) rest against one another and the first and fifth surfaces (16, 26) rest against one another to keep the first and second side edges (5, 6) in contact with one another;

the fourth and eighth surfaces (12, 22) rest against one another; and the third and seventh surfaces (11, 21) rest against one another.

2. The connection according to claim 1 wherein the second and sixth surfaces (14, 24) extend at an incline with respect to the first and second top sides (3, 4).

3. The connection according to claim 1 wherein the second and sixth surfaces (14, 24) extend parallel to the first and second top sides (3, 4).

4. The connection according to claim 1 wherein:

the first upper lip (31) comprises an end surface (13) at the distal end of the first upper lip (31);

the lower lip (33) comprises an end surface (18) at the distal end of the lower lip (33); and the end surfaces (13, 18) are substantially aligned in the same plane.

5. The connection according to claim 1 wherein the distal end of the tongue (32) projects beyond the distal end (21) of the second upper lip (30).

6. The connection according to claim 1 wherein the first upper lip (31) and the lower lip (33) are embodied in one piece with the first panel (1).

7. The connection according to claim 1 wherein the second upper lip (30) and the tongue (32) are embodied in one piece with the second panel (2).

8. The connection according to claim 2 wherein:

the first upper lip (31) comprises an end surface (13) at the distal end of the first upper lip (31);

the lower lip (33) comprises an end surface (18) at the distal end of the lower lip (33); and the end surfaces (13, 18) are substantially aligned in the same plane.

9. The connection according to claim 3 wherein:

the first upper lip (31) comprises an end surface (13) at the distal end of the first upper lip (31);

the lower lip (33) comprises an end surface (18) at the distal end of the lower lip (33); and the end surfaces (13, 18) are substantially aligned in the same plane.

10. The connection according to claim 2 wherein the distal end of the tongue (32) projects beyond the distal end (21) of the second upper lip (30).

11. The connection according to claim 3 wherein the distal end of the tongue (32) projects beyond the distal end (21) of the second upper lip (30).

12. The connection according to claim 4 wherein the distal end of the tongue (32) projects beyond the distal end (21) of the second upper lip (30).

13. The connection according to claim 2 wherein the first upper lip (31) and the lower lip (33) are embodied in one piece with the first panel (1).

14. The connection according to claim 3 wherein the first upper lip (31) and the lower lip (33) are embodied in one piece with the first panel (1).

15. The connection according to claim 4 wherein the first upper lip (31) and the lower lip (33) are embodied in one piece with the first panel (1).

16. The connection according to claim 5 wherein the first upper lip (31) and the lower lip (33) are embodied in one piece with the first panel (1).

17. The connection according to claim 2 wherein the second upper lip (30) and the tongue (32) are embodied in one piece with the second panel (2).

18. The connection according to claim 3 wherein the second upper lip (30) and the tongue (32) are embodied in one piece with the second panel (2).

19. The connection according to claim 4 wherein the second upper lip (30) and the tongue (32) are embodied in one piece with the second panel (2).

20. The connection according to claim 5 wherein the second upper lip (30) and the tongue (32) are embodied in one piece with the second panel (2).

21. The connection according to claim 6 wherein the second upper lip (30) and the tongue (32) are embodied in one piece with the second panel (2).

22. A panel connection, particularly for flooring panels, comprising:

a first panel (1) having a first side edge (5), the first side edge having a first upper lip (31) and a lower lip (33) forming a groove (35) that extends parallel to the first side edge (5), the groove (35) having a first surface (16) on the lower lip (33) extending at an upward incline with respect to a first top side (3) of the first panel (1), the groove (35) also having a second surface (14) on the upper lip (31) opposite the first surface (16), the first upper lip (31) having an end surface (13) at the distal end of the first upper lip (31) and the lower lip (33) having an end surface (18) at the distal end of the lower lip (33), the end surfaces (13, 18) being substantially aligned in the same plane, the first side edge (5) also having a third surface (11) and a fourth surface (12), the third surface (11) extending substantially perpendicular to the first top side (3) and the fourth surface (12) extending substantially parallel to the first top side (3); and a second panel (2) having a second side edge (6), the second side edge (6) having a tongue (32) extending parallel to the second side edge (6), the tongue (32) having a fifth surface (26) on the bottom thereof extending at an upward incline with respect to a second top side (4) of the second panel (2), the tongue (32) also having a sixth surface (24) forming the top thereof, the second side edge (6) also having a second upper lip (30) formed by a seventh surface (21) and an eighth surface (22), the seventh surface (21) extending substantially perpendicular to the second top side (4) and the eighth surface (22) extending substantially parallel to the second top side (4), the tongue (32) and the second upper lip (30) forming a second groove (37); wherein, in an interlocked state of the connection:

the second and sixth surfaces (14, 24) rest against one another and the first and fifth surfaces (16, 26) rest against one another to keep the first and second side edges (5, 6) in contact with one another;

the fourth and eighth surfaces (12, 22) rest against one another; and the third and seventh surfaces (11, 21) rest against one another.

23. The connection according to claim 22 wherein the first upper lip (31) completely covers the first surface (16).

24. A panel connection, particularly for flooring panels, comprising:

a first panel (1) having a first side edge (5), the first side edge having a first upper lip (31) and a lower lip (33) forming a groove (35) that extends parallel to the first side edge (5), the groove (35) having a first surface (16) on the lower lip (33) extending at an upward incline with respect to a first top side (3) of the first panel (1), the groove (35) also having a second surface (14) on the upper lip (31) opposite the first surface (16), the first side edge (5) also having a third surface (11) and a fourth surface (12), the third surface (11) extending substantially perpendicular to the first top side (3) and the fourth surface (12) extending substantially parallel to the first top side (3); and a second panel (2) having a second side edge (6), the second side edge (6) having a tongue (32) extending parallel to the second side edge (6), the tongue (32) having a fifth surface (26) on the bottom thereof extending at an upward incline with respect to a second top side (4) of the second panel (2), the tongue (32) also having a sixth surface (24) forming the top thereof, the second side edge (6) also having a second upper lip (30) formed by a seventh surface (21) and an eighth surface (22), the seventh surface (21) extending substantially perpendicular to the second top side (4) and the eighth surface (22) extending substantially parallel to the second top side (4), the tongue (32) and the second upper lip (30) forming a second groove (37), the distal end (42) of the tongue (32) projecting beyond the distal end (21) of the second upper lip (30); wherein, in an interlocked state of the connection:

the second and sixth surfaces (14, 24) rest against one another and the first and fifth surfaces (16, 26) rest against one another to keep the first and second side edges (5, 6) in contact with one another;

the fourth and eighth surfaces (12, 22) rest against one another; and the third and seventh surfaces (11, 21) rest against one another.

25. The connection according to claim 24 wherein the first upper lip (31) completely covers the first surface (16).

26. The connection according to claim 25 wherein the first upper lip (31) has an end surface (13) at the distal end of the first upper lip (31) and the lower lip (33) has an end surface (18) at the distal end of the lower lip (33), the end surfaces (13, 18) being substantially aligned in the same plane.

27. The connection according to claim 24 wherein the first upper lip (31) has an end surface (13) at the distal end of the first upper lip (31) and the lower lip (33) has an end surface (18) the distal end of the lower lip (33), the end surfaces (13, 18) being substantially aligned in the same plane.

28. A panel connection, particularly for flooring panels, comprising:

a first panel having a first side edge, the first side edge having a first upper lip and a lower lip forming a groove that extends parallel to the first side edge, the lower lip forming part of an underside of the first panel, the groove having a first surface on the lower lip extending at an upward incline with respect to a first top side of the first panel, the groove also having a second surface on the first upper lip opposite the first surface, the first upper lip completely covering the first surface, the first side edge having a third surface extending substantially perpendicular to the first top side, the first upper lip having a fourth surface forming a top thereof, a second panel having a second side edge, the second side edge having a tongue extending parallel to the second side edge, the tongue having a fifth surface on the bottom thereof extending at an upward incline with respect to a second top side of the second panel, the tongue also having a sixth surface forming the top thereof, the second side edge having a seventh surface extending substantially perpendicular to the second top side, the seventh surface adjoining the second top side, the second side edge having a second upper lip, the second upper lip and the tongue forming a second groove, the second groove having an eighth surface on the second upper lip extending substantially parallel to the second top side; wherein, in an interlocked state of the connection:

the first and fifth surfaces rest against one another;

the fourth and eighth surfaces rest against one another; and the third and seventh surfaces rest against one another.

29. The connection according to claim 28 wherein the seventh surface forms part of the second upper lip.

30. The connection according to claim 28 wherein the second and sixth surfaces also rest against one another in the interlocked state of connection.

31. The connection according to claim 28 wherein the second and sixth surfaces are not inclined with respect to the first and second top sides.

32. The connection according to claim 28 wherein:

the groove of the first panel further has a back surface extending substantially perpendicular to the first top side; and the third surface and the back surface are substantially aligned in the same plane.

33. The connection according to claim 28 wherein the distal end of the second upper lip projects beyond thedistal end of the tongue.

* * * * *